United States Patent [19]

Mott

[11] Patent Number: 4,550,780

[45] Date of Patent: Nov. 5, 1985

[54] PRESSURE OPERATED SAFETY VALVE WITH LOCK MEANS

[75] Inventor: James D. Mott, Houston, Tex.

[73] Assignee: Hydril Company, Los Angeles, Calif.

[21] Appl. No.: 259,019

[22] Filed: Apr. 30, 1981

Related U.S. Application Data

[63] Continuation of Ser. No. 256,194, May 23, 1972, abandoned, which is a continuation of Ser. No. 72,034, Sep. 14, 1970.

[51] Int. Cl.[4] ..... E21B 34/10

[52] U.S. Cl. ..... 166/323; 166/321

[58] Field of Search ..... 166/323, 322, 324, 321

[56] References Cited

U.S. PATENT DOCUMENTS

| | | | |
|---|---|---|---|
| 2,162,578 | 6/1931 | Hacker | 166/323 |
| 2,998,070 | 8/1961 | Tamplen et al. | 166/319 |
| 2,998,077 | 8/1961 | Keithahn | 166/319 |
| 3,078,923 | 2/1963 | Tausch | 166/224 |
| 3,126,908 | 3/1964 | Dickens | 137/460 |
| 3,236,255 | 2/1966 | Sizer | 137/494 |
| 3,292,706 | 12/1966 | Grimmer et al. | 137/459 |
| 3,310,114 | 3/1967 | Dollison | 137/510 |
| 3,398,762 | 8/1968 | Fredd | 137/498 |
| 3,470,903 | 10/1969 | Scott | 137/495 |

*Primary Examiner*—James A. Leppink
*Assistant Examiner*—Hoang C. Dang
*Attorney, Agent, or Firm*—Dodge, Bush & Moseley

[57] ABSTRACT

A pressure operated safety valve adapted to be mounted in a well tubing for normally being movable to an open position by control fluid supplied from the surface, and which valve is automatically closed when the well pressure reaches a predetermined amount, whereby blowouts of the well are automatically prevented. The valve has locking means therewith which is operable by fluid pressure supplied through the well tubing from the surface for locking the valve open in the event the valve is malfunctioning in its normal operation and a "Storm" choke or other type of safety valve is to be added in the well tubing, or it is desired to temporarily or permanently lock the valve open for any other purpose. Means are also provided for releasing the locking means to return the valve to its normal operating condition if desired.

39 Claims, 20 Drawing Figures

FIG.1C
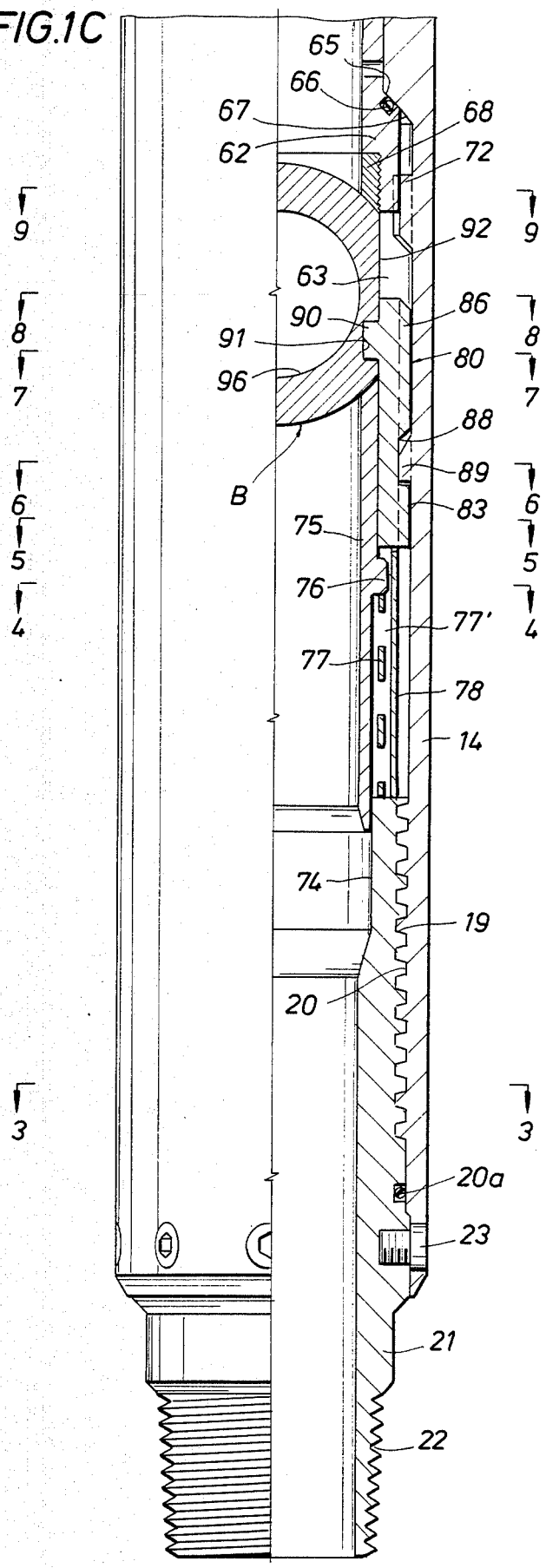
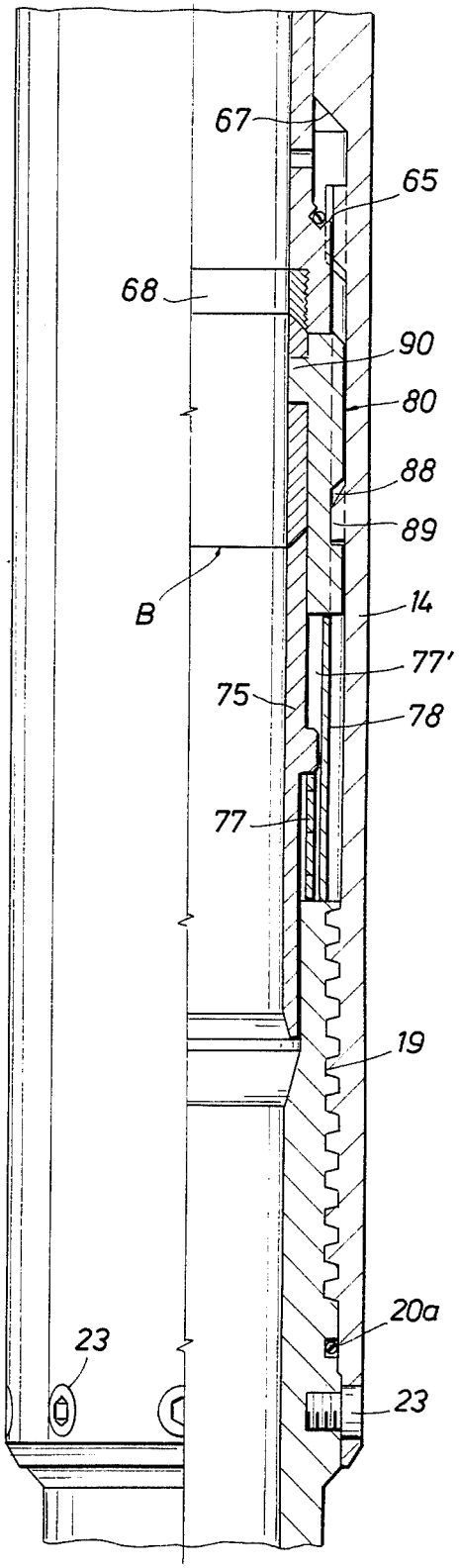
FIG. 2C

FIG. 3
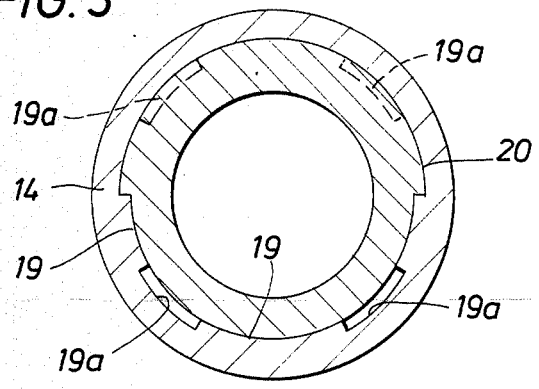
FIG. 4
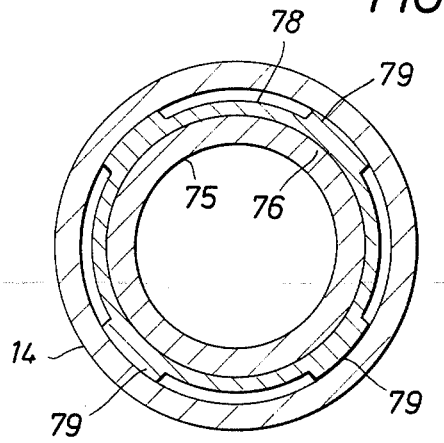
FIG. 5
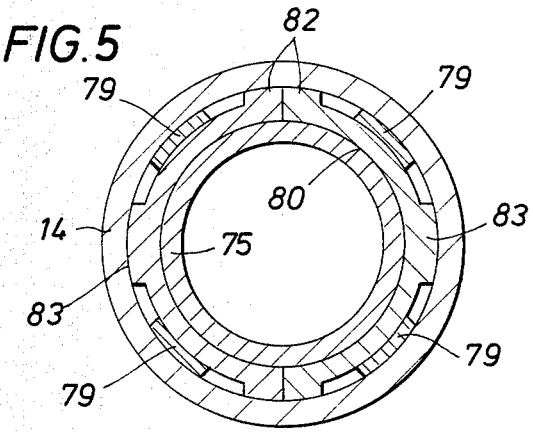
FIG. 6
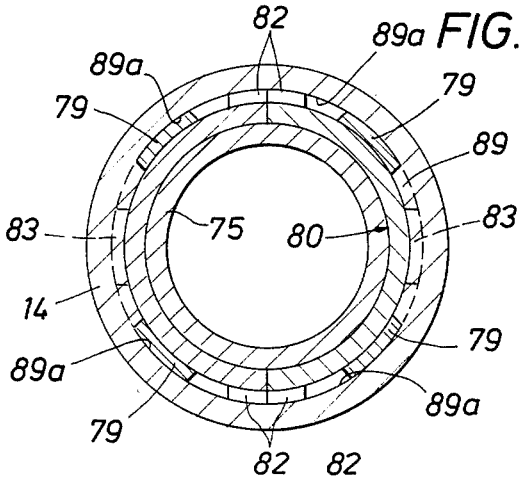
FIG. 7
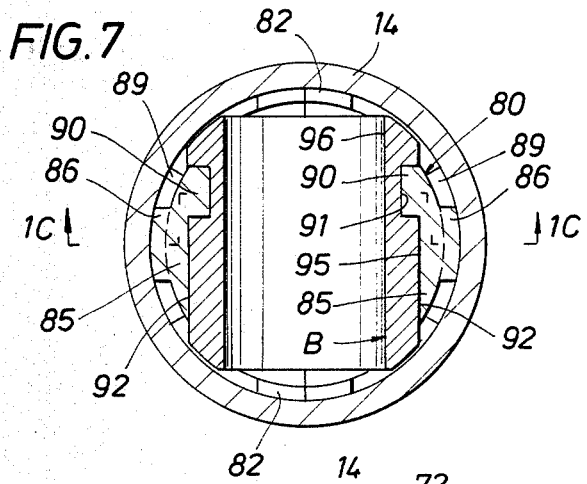
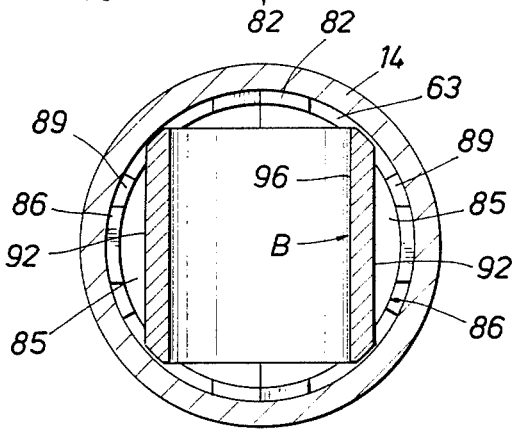
FIG. 8
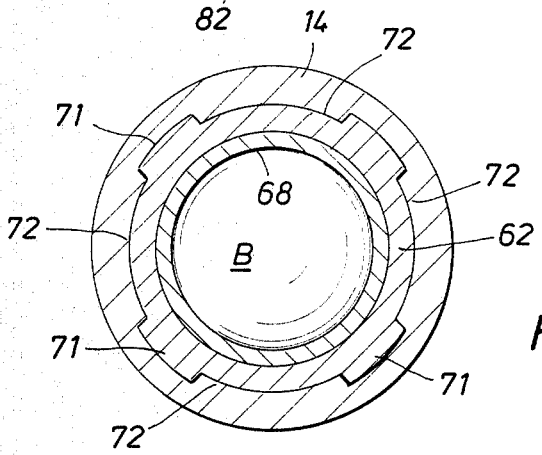
FIG. 9

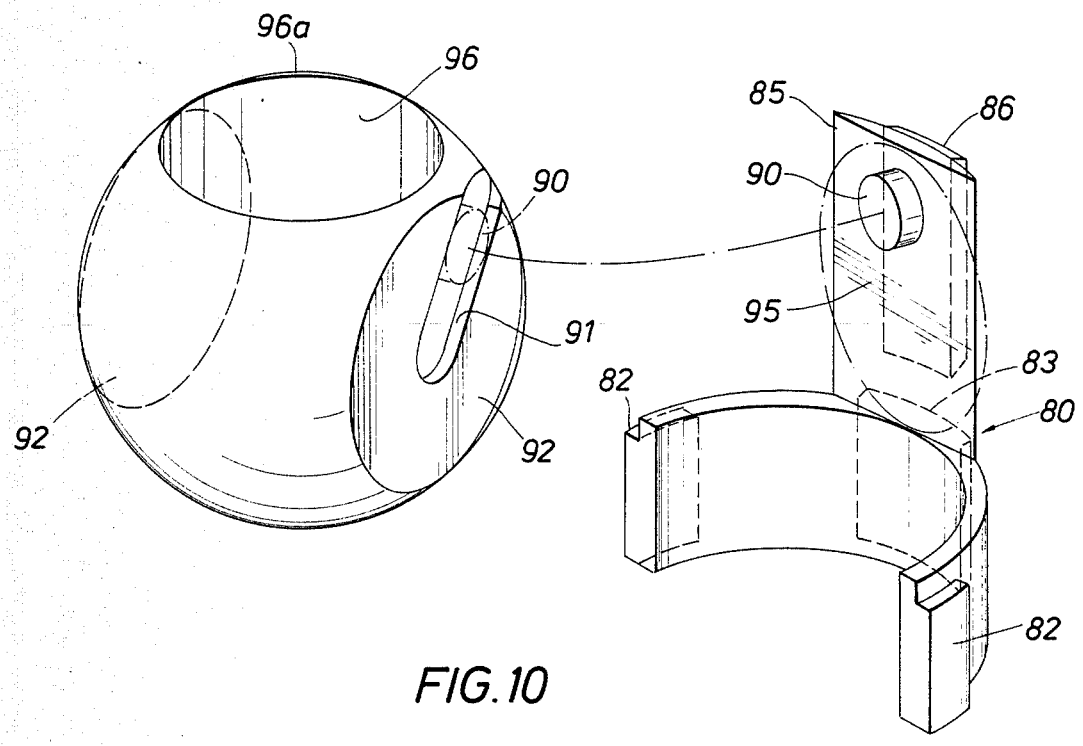
FIG. 10
FIG. 11
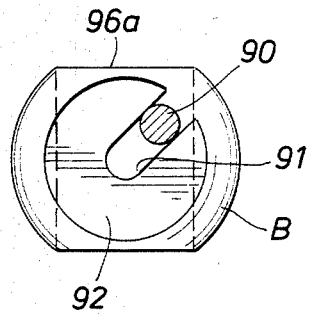
FIG. 12
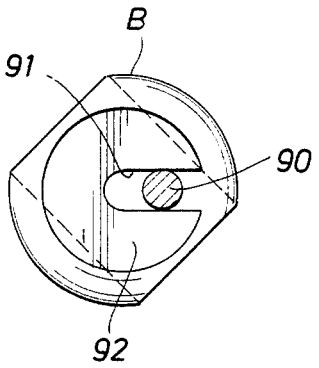
FIG. 13
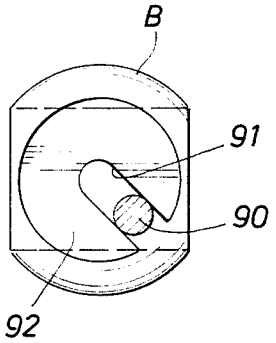
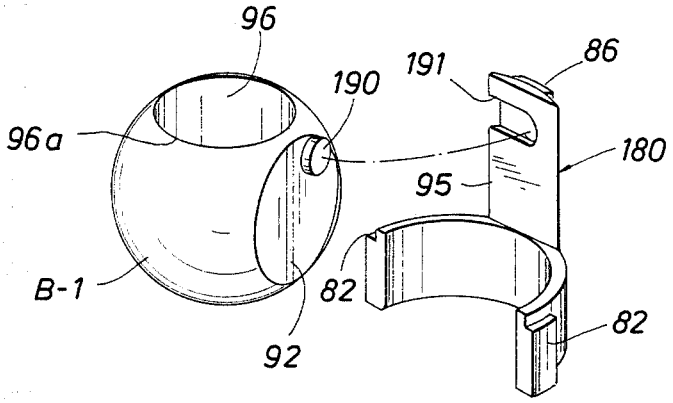
FIG. 14

PRESSURE OPERATED SAFETY VALVE WITH LOCK MEANS

This application is a continuation of application Ser. No. 256,194, filed May 23, 1972, now abandoned, which is a continuation of Ser. No. 72,034, filed Sept. 14, 1970.

BACKGROUND OF THE INVENTION

The field of this invention is pressure operated safety valves for disposition in well tubing.

In the past, it has been the practice to use devices in producing wells, particularly offshore wells, which automatically close when the well pressure reaches a predetermined amount for the purpose of preventing well blowouts and the resultant fires and pollution of the seas with oil.

The most common type used has been marketed under the name, "Storm" choke, but it is not as widely used at it should be because it is generally damaged by sand or other abrasives flowing therethrough with the oil during normal production, so that it is not operative for preventing blowouts when they occur.

Ball-type safety valves, examples of which are found in U.S. Pat. No. 2,894,715; U.S. Pat. No. Re. 25,471; U.S. Pat. No. 2,998,070; U.S. Pat. No. 3,035,808; U.S. Pat. No. 3,126,908 and U.S. Pat. No. 3,189,044, have also been used in an attempt to provide automatic closing of wells to prevent well blowouts. However, even the best of the safety valves are subject to malfunctioning, particularly after they have been left in a well for a long period of time. Since the government requires periodic testing of the safety valves, those that are defective can be located, but with the previously known valves, even if they were found to be defective, nothing could be done to immobilize or replace the defective valve, short of shutting down the well and attempting a removal of the defective valve with all of the attendant problems.

SUMMARY OF THE INVENTION

The present invention relates to a ball-type safety valve which is adapted to be placed downhole in a well tubing for normally functioning to close off any flow of oil through the tubing when the fluid pressure in the well reaches a predetermined point. A lock means is provided with the valve for locking the valve in an open position so that the valve is effectively removed from use while being left in the well tubing, whereby other safety devices such as the "Storm" choke can be positioned in the well so that some safety means in still available in the well tubing.

Also, the safety valve of this invention can be temporarily locked open while performing well operations therethrough or for any other purpose, and later the locking means can be released. Both the locking and the releasing may be accomplished using fluid pressure supplied through the well tubing from the surface.

BRIEF DESCRIPTION OF THE DRAWINGS

FIGS. 1A, 1B and 1C are views partly in elevation and partly in section, from the top to the bottom of the safety valve of this invention, with FIG. 1C being taken on line 1C—1C of FIG. 7 to better illustrate the eccentric valve pivots;

FIGS. 2A, 2B and 2C are views similar to FIGS. 1A, 1B and 1C, respectively, but showing the parts in different positions;

FIGS. 3–9, inclusive, are transverse sectional views taken on the corresponding section lines of FIG. 1C;

FIG. 10 is an exploded isometric view of the ball-valve and one-half of the valve pivot unit which is operably connected therewith;

FIGS. 11–13 are schematic views illustrating consecutive positions of the ball-valve relative to the pivot pins as the ball-valve moves from the open position, to an intermediate position, and then to the closed position;

FIG. 14 is a view similar to FIG. 10, but illustrating a modification wherein the pivot pins are carried by the ball-valve and the slots are formed in the pivot unit;

DESCRIPTION OF THE PREFERRED EMBODIMENTS

Figure 1A:
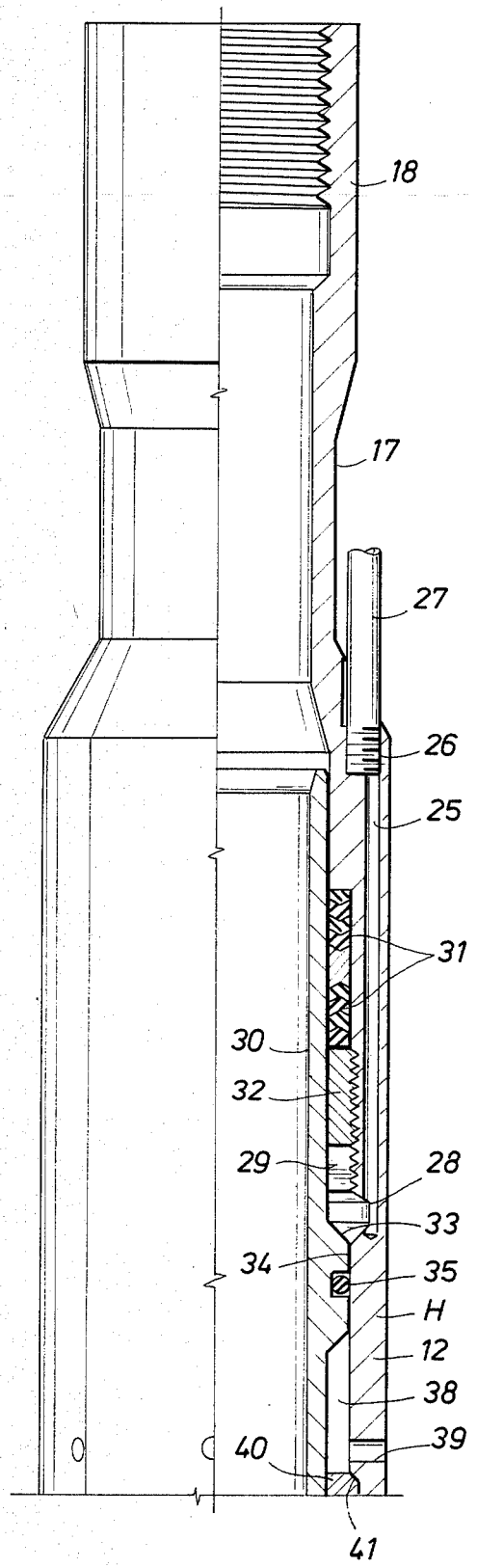

The safety valve of this invention has a housing H which includes three sections 12, 13, and 14 coupled together at threads 15 and 16, and provided with O-ring seals 15*a* and 16*a*. The upper housing section 12 terminates in an adapter 17 having a threaded box 18 for attachment in a tubing string thereabove (not shown). At the lower end of lower housing section 14, partially longitudinally cut-away female threads 19 (to be further described) are provided for threaded engagement with male threads 20 on an adapter 21 having external threads 22 at its lower extremity for attachment to a section of the tubing string therebelow (not shown). An O-ring seal 20*a* is provided between the adapter 21 and the housing section 14. One or more set screws 23 are provided to prevent an inadvertent release of the threaded connection 19, 20.

The wall of the top housing section 12 (FIG. 1A) has a longitudinally formed passage 25 terminating in a threaded fitting 2*d* for attachment of a hose or pipe 27 leading to the ground level or surface. The passage 25 connects through a port 28 with a chamber 29 between the section 12 and an upper valve actuator sleeve 30 slidably received in the housing H. Packings 31 and a packing nut 32 are provided in chamber 29, while the other end of the chamber is formed by an inclined wall 33 on an annular collar 34 formed on the sleeve 30. The collar 34 slidably engages the inner wall of housing section 12 and is provided with a sealing O-ring 35. A second chamber 38 between the sleeve 30 and the section 12 and beneath the collar 34 communicates exteriorly of the housing H through a circumferential row of ports 39 for the egress and ingress of fluid during longitudinal movement of the sleeve 30 relative to the housing H. A stop ring 40 is provided which bears against an internal shoulder 41 on the section 12. A packing 42 is positioned beween the ring 40 and the threaded end 43 of intermediate housing section 13. One or more securing set screws 45 may be provided (dotted lines, FIGS. 1B, 2B).

Figure 1B:
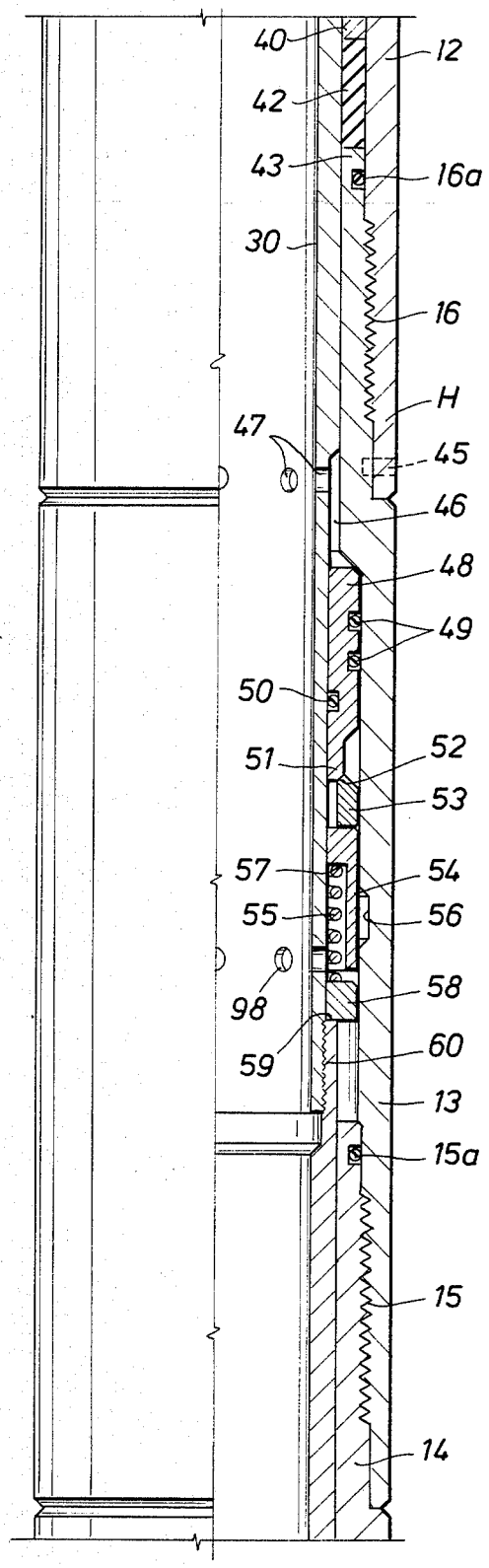

A third annular chamber 46 is provided between upper sleeve 30 and the intermediate housing section 13, and this chamber communicates interiorly of the sleeve 30 through ports 47 (FIG. 1B). An enlarged portion of the chamber 46 slidably receives a locking piston 48 which carries O-rings 49 and 50 and preferably has a reduced nose 51 at its lower end with an inclined or beveled extremity 52 normally bearing against a split spring ring locking detent 53. A locking sleeve 54 is slidable in the enlarged part of chamber 46 and encompasses and confines a coiled spring 55 under compression which normally urges the locking sleeve 54 against the locking detent 53 to confine same between the sleeve 54 and the piston 48. The locking sleeve 54 is abreast of and covers a locking recess 56 in the wall of housing section 13 during normal operation of the valve, as will be more fully explained. The spring 55 is compressed between a seat 57 on the sleeve 54 and a stop ring 58 bearing against a shoulder 59 formed adjacent threads 60 at an intermediate portion of the upper housing section 30. The upper valve actuating sleeve 30 has a collar 62 disposed in a fourth annular chamber 63 between the housing section 14 and a ball-type valve B (FIGS. 1C, 10). The collar 62 has an inclined valving surface 65 provided with an O-ring seal 66 for engagement with inclined sealing shoulder 67 on the housing section 14. An annular seat ring 68 formed of rubber, metal, plastic or other suitable material is internally threaded in the collar 62 for sealingly engaging the upstream face of ball valve B.

As best shown in FIG. 9, the collar 62 has four external splines or wings 71 in quadrature slidably positioned in corresponding longitudinal grooves in the inner surface of housing section 14, with sector-shaped ridges 72 therebetween which prevent rotation of the sleeve section 30 relative to the housing H.

At the lower end of housing section 14, the internal threads 19 are longitudinally cut away to form longitudinal slots **19*a* to provide for insertion of the valve and actuator assembly into the housing H, as will be explained. However, male teeth 20 on the adapter sub 21 are not cut away. Slidably received in a slightly enlarged upper portion 74 of the adapter sub 21 is the lower valve actuator sleeve 75** which, at its upper end, bears against the ball valve B.

The lower sleeve 75 has an intermediate external collar 76 extending into a fifth chamber 77' for engagement by a heavy coiled compression spring 77 which also engages the adapter 21, and which is encompassed by a retainer sleeve 78 having radial wings 79 in quadrature (FIGS. 4–6). The inner circular portion of sleeve 78 extends only between the end of the adapter 21 and the pivot valve unit 80, which is preferably cylindrical and longitudinally split (FIGS. 5 and 6) to facilitate assembly. The wing portions 79, however, extend upwardly into the spaces between radial wings 82 and 83 on the valve pivot means 80 (FIG. 5).

Figure 2A:
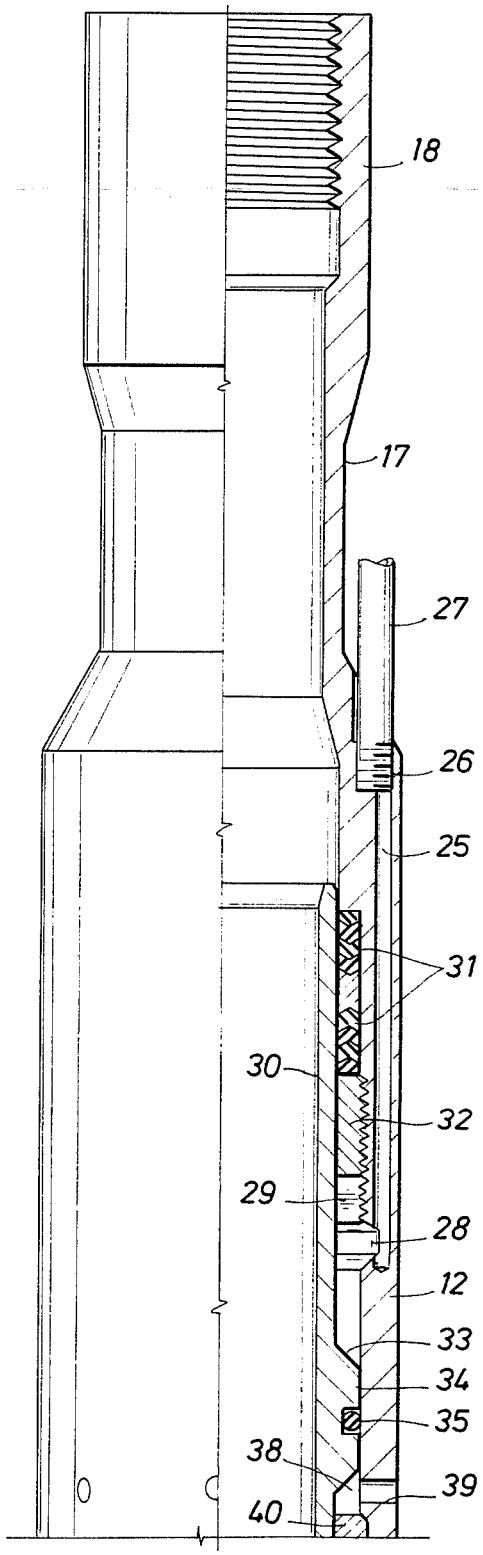

The valve pivot means 80 has upward diametrically spaced tongue portions 85 (FIGS. 7, 8 and 10) with radial wings 86 bearing against the housing H and aligned and circumferentially coextensive with wing portions 83 (FIG. 5) at the lower end of the pivot means 80. Between the wing portions 83 and 86, the pivot means 80 has annular recesses 88 to receive sector shaped ridges 89 on the housing section 14 (FIG. 6). The tongues 85 include inwardly projecting pivot pins 90 (FIGS. 1C, 7 and 10) which are received in slots or recesses 91 in the flat side surfaces 92 on ball valve B. The tongue parts 85 have complementary flat surfaces 95 abutting the valve surfaces 92 and upon which the valve surfaces rotate. The valve B is generally ball shaped (FIG. 10) with a cylindrical through passage 96 which, in diameter, substantially equals the internal diameter of the valve actuator sections 30 and 75 and also the adapters 17 and 21 which, in turn, have substantially the same internal diameter as that of the conventional tubing string (not shown) connected thereto. In other words, the valve has a full opening when in the open position (FIG. 2C) for the passage of well tools and for performing well operations therethrough.

The parts may be assembled in the following sequence:

1. The portion of the valve actuator sleeve 30 below the threads 60 is inserted in the lowermost housing section 14 from the bottom and turned as necessary to align its terminal wings 71 (FIG. 9) so as to pass between the internal sectoral ridges 72 on the housing H so that the O-ring 66 seats against the housing shoulder 67.

2. The piston 48, locking detent 53, locking sleeve 54, spring 55, and stop ring 58 are inserted upon the upper valve actuator sleeve 30 which is then screwed together at the threads 60 with its portion therebelow.

3. The housing section 13 is then screwed together with section 14 at the threads 15 so that the annular recess 56 is bridged by the locking sleeve 54.

4. The packing 42 and the stop ring 40 are applied upon protruding sleeve 30.

5. The packing 31 and the packing nut 32 are inserted in housing section 12 through the lower end thereof, and then the section 12 is attached at threads 16 to the end of the housing section 13.

6. The ball valve B is next inserted. Since the maximum diameter portions of the ball valve B are greater than the internal diameter of the crests of the threads 19 (Compare FIGS. 3 and 7), the valve B must be turned to the position shown in FIG. 8 so that its four surfaces are positioned in the longitudinal slots **19*a* cut in the threads 19 (Compare FIGS. 3 and 8). After the ball valve B is above the threads 19, the valve pivot unit 80 is inserted with its aligned splines or wings 83, 86 also aligned with the slots 19*a*. When the unit 80 is above the threads 19, the pivot pins 90 are moved into the pivot slots 91 of the ball valve B, and to accomplish this, a slight rotation of the ball valve B, about twenty degrees, towards an open position is necessary. After the pins 90 are in the slots 91, the ball valve B and unit 80 are rotated about the longitudinal axis enough to align the splines 83, 86 with longitudinal grooves 89*a* so that the ball valve B can then be moved to the seated position (FIG. 1C) in contact with the ring 68 at which time the ball valve B and the unit 80 are rotated about the longitudinal axis ninety degrees to position the lugs 86 directly above the lugs 89 to thereby fix the unit 80 in the housing H (FIGS. 7 and 8). Thereafter, the retainer sleeve 78 is positioned so that it can be moved upwardly with the splines 79 moving upwardly through the slots 19*a* to the position shown in FIG. 1C. The lower actuator sleeve 75 and the spring are then positioned as shown so that when the adapter 21 is threaded to its fully connected position, the retainer sleeve 78 and the unit 80 are locked against movement while the spring 77 is subject to being compressed from the FIG. 1C position to the FIG. 2C position. One or moe set screws 23 are used to prevent unintentional unthreading of the threads 20 from the threads 19**.

In use or operation, the safety valve of this invention is inserted in a production tubing string in a well where it is desired to provide for automatic closing of the well in the event the well pressure should become excessive, indicating possible imminence of a blowout. Normally, the spring 77 urges the lower actuator sleeve 75 upwardly to maintain the valve passage 96 transversely of the flow passage within the sleeves 30 and 75 to thereby position the valve in the closed position (FIGS. 1C and 9). The full force of well pressure then is exerted against the lower face of the ball valve B urging it into sealing contact with the ring 68, the upward movement of which is limited by the engagement of the shoulder 65 and the seal 66 with the shoulder 67, so that the flow passage is effectively sealed off. In order to open the valve, control fluid under pressure is supplied selectively from the surface through the pipe 27, passage 25 and port 28 and applied to the annular wall 33 and seal 35 on the upper actuator section 30, which move the upper actuator section 30 downwardly and cause rotation of the ball valve B about the pivot pins 90 from the closed position (FIG. 13) to a partially open position (FIG. 12) and finally to the open position (FIGS. 2A and 11) with the valve passage 96 aligned with the flow passages through the valve actuator sections 30 and 75.

It should be noted that when the control fluid is supplied to open the valve B, the upper valve actuator sleeve 30 moves downwardly so as to unseat the seal ring 66 from sealing contact with the surface 67 before the ball valve B has rotated enough for its annular edge **96*a* (FIG. 10) to enter the bore of the sleeve 30. This results in a by-pass of fluid around the valve B prior to directing flow through the flow passage 96 thereof, whereby erosive fluid cutting action along such edge 96*a*** is minimized, and the effective life of the ball valve B is increased, as compared to prior art constructions.

In the fully open position of the ball valve B, the spring 77 is substantially fully compressed (FIG. 2C). Thus, in normal operation of the safety valve of this invention, the ball valve B is held in the open position by the control fluid which is at least sufficient to overcome the returning force of the spring 77. It is to be noted that the cross-sectional area of the upper end of the sleeve 30 is less than the cross-sectional area of the sleeve 30 at the ports 47, so that the well fluid is also acting to maintain an upward force on the sleeve 30, which likewise must be overcome by the control fluid to move the ball B to the open position. To return the ball valve B to the closed position automatically when the well pressure reaches a predetermined point, such well pressure below the ball valve B must be sufficiently high to overcome the control fluid pressure. When the control fluid pressure has been overcome or offset by the downhole well pressure acting upwardly below the valve B, the compressed spring 77 then acts to move the lower valve actuator sleeve 75 upwardly so that the ball B is rotated about the eccentric pivot pins 90 to rotate the ball valve B from the open position (FIG. 2C) to the closed position (FIG. 1C).

During normal operation of the safety valve of this invention, the fluid pressure acting on the piston 48 is equalized since there is fluid communication above the piston 48 through the ports 47 and below the piston 48 through the ports 98. However, should it become desirable to lock the ball valve B in the fully open position illustrated in FIG. 2C, this may be accomplished by lowering a conventional bridge plug P (FIG. 15) into the tubing string T so that the plug P is disposed in the sleeve 30 between the upper ports 47 and the lower ports 98. The bridge plug P may be suspended in the tubing string T in a recess 90 formed at a joint or collar in the conventional manner, using spring-loaded catch fingers 91 or any other suitable releasable support means as is well known to those skilled in the art. Thus, after the bridge plug P has served its purpose, it may be removed from the tubing string T so that normal operations may occur through the tubing string T and the valve of this invention.

Figure 2B:
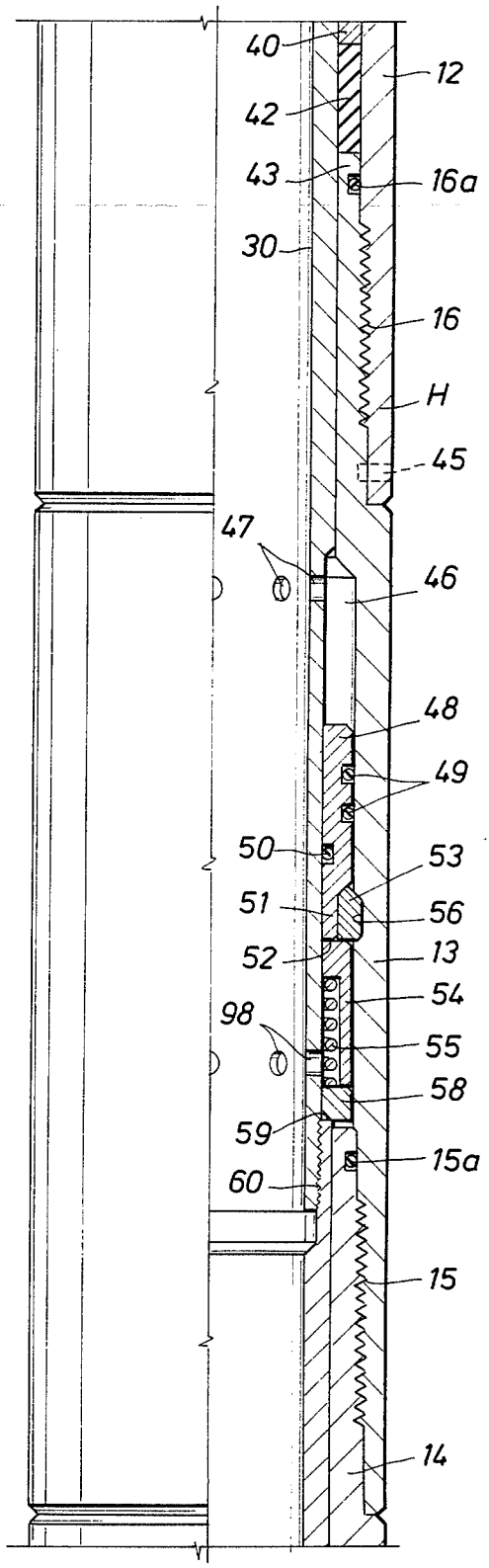
Figure 15:
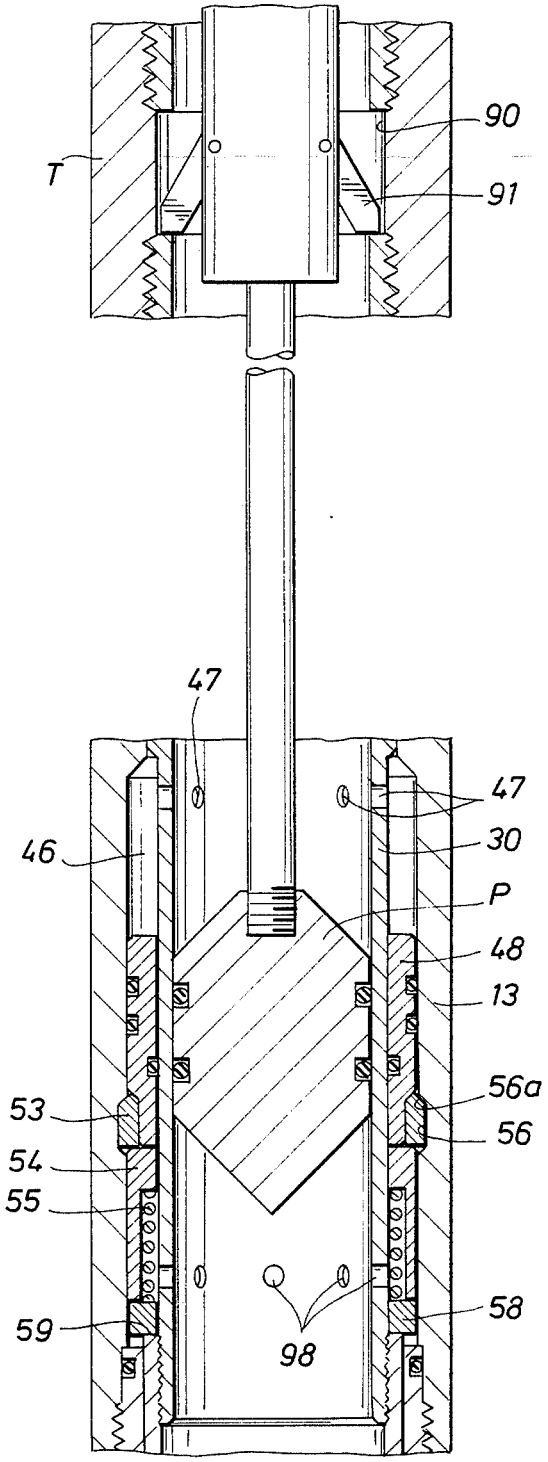
FIG. 15 is a view illustrating a typical bridge plug in position within the safety valve of this invention for directing fluid pressure to actuate the lock means of the valve for locking the valve in the open position.

When the bridge plug P is positioned as illustrated in FIG. 15, fluid under pressure may then be forced downwardly through the ports 47 to the chamber 46 above the piston 48, thereby acting to move the piston 48 downwardly from its normal position (FIG. 1B) to the locked position (FIGS. 2B and 15). The downward movement of the piston 48 acts to move the locking sleeve 54 downwardly and also the radially expansible detent ring 53 downwardly so that the ring 53 becomes laterally aligned with the locking recess 56 and expands outwardly into such recess 56. The spring 55 exerts a constant upward force on the sleeve 54, but when the detent 53 has expanded outwardly into the recess 56, the spring 55 does not have sufficient force to unseat the locking ring 53 from the recess 56. Therefore, the detent ring 53 is locked in the recess 56 and prevents the sleeve 54 from moving upwardly. Since the sleeve 54 is in engagement with the annular ring 58 which in turn engages the shoulder 59 of the sleeve 30, the sleeve 30 is thereby locked in its lower position by the detent ring 53 being in the locking recess 56.

Once the piston 48 has moved the detent ring 53 downwardly enough to position it for movement into the recess 56, the bridge plug P may be removed from the well and the locking means or detent 53 will thereafter hold the ball valve B in the open position (FIG. 2C).

Figure 16:
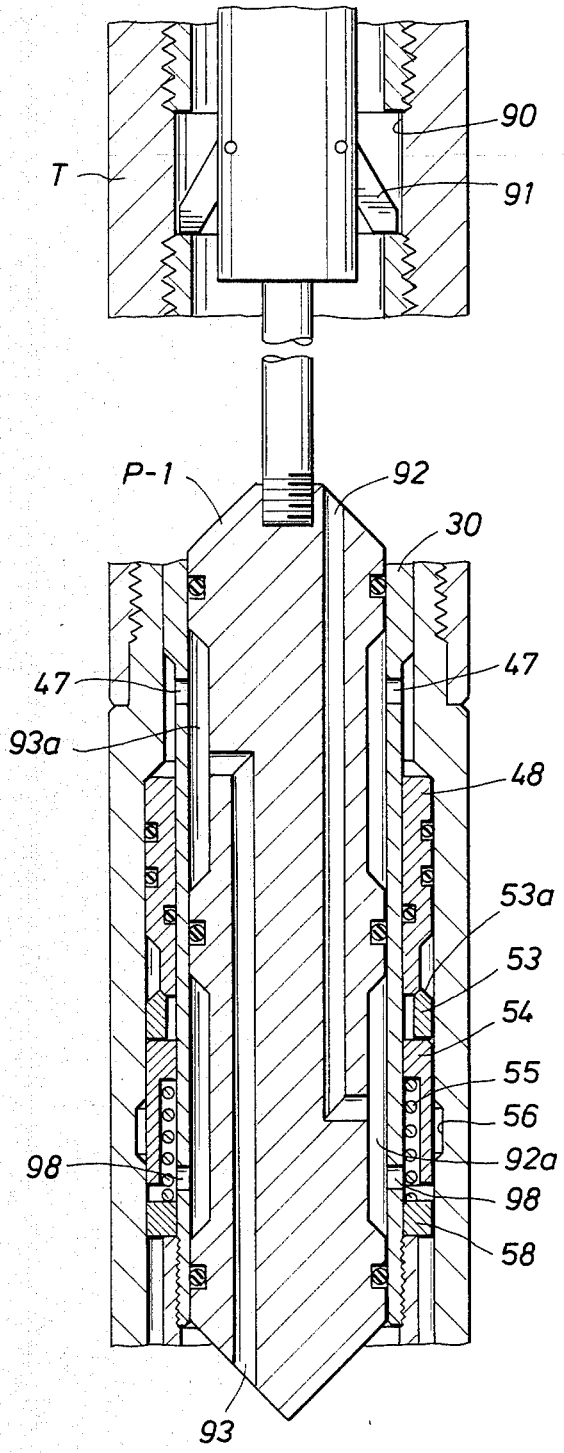
FIG. 16 is a vertical sectional view, illustrating a conventional cross-over plug mounted in the safety valve of this invention for directing fluid to the lock means for releasing same when it is desired to re-open the valve after it has been locked.

Although the locking means illustrated and described in connection with FIG. 15 is not used unless it is desired to leave the valve B in the open position for an extended period of time, and sometimes permanently, it occasionally develops that the ball valve B should be closed even after it has been locked open by the locking means of FIG. 15. Should this occur, a conventional cross-over plug P-1 (FIG. 16) may be lowered downwardly through the tubing string T and positioned as shown in FIG. 16. The cross-over plug P-1 is supported in a recess 90 by releasable latch fingers 91 in the same manner as heretofore indicated in connection with the bridge plug P, it being understood that such structure is conventional and may or may not be utilized. The plug P is solid and is provided with suitable seals externally for engagement with the inside surface of the actuator sleeve 30, but it does have a longitudinal port or passage 92 which communicates from the area above the cross-over plug P-1 to an annular recess **92*a* which is disposed over the openings 98 in the sleeve 30. A second passage 93 communicates with the area below the cross-over plug P-1 in the sleeve 30 and with an annular passage 93*a* which is aligned with the ports 47. To release the locking detent 53 from the locking recess 56, fluid under sufficient pressure is pumped downwardly through the tubing string T so that is passes through the passage 92, through the annular passage 92*a* and the inlet ports 98 for imparting an upward force to the piston 48 and the locking sleeve 54. Such fluid pressure initially forces the nose 51 upwardly to a point above the ring 53 and then the pressure must be sufficient, together with the force of the spring 55, to cause the locking ring 53 to radially contract and thus permit the locking detent 53 to move upwardly out of the recess 56. To facilitate such contraction, the detent ring 53 preferably has an upper tapered annular surface 53*a* which is in contact with a similar tapered surface 56***a* when the locking ring 53 is in the recess 56. Such surfaces permit an inward and upward sliding action of the ring 53, and since the ring is split and has sufficient space to contract back to its original diameter so as to fit within the bore of the housing section 13, the upward force thus causes the upward movement of the locking ring detent 53 back to the position shown in FIG. 16. After the ring detent 53 has thus been released to the unlocked position, the cross-over plug P-1 may be removed from the tubing string T with a fishing tool or any other suitable removing device, and thereafter, normal usage of the valve may take place if desired.

In FIG. 14, an alternate ball-type valve B-1 is illustrated, which has a pin 190 on each side 92 for fitting into a slot 191 on the pviot unit 180. Thus, the ball valve B-1 is essentially the same as the ball valve B, and the unit 180 is essentially the same as the unit 80, with like parts having like designations, except that the pins and slots for the pivoting action have been reversed. The movements of the ball valve B-1 are the same as heretofore described in connection with the ball valve B, and as will be well understood by those skilled in the art.

The foregoing disclosure and description of the invention are illustrative and explanatory thereof, and various changes in the size, shape, and materials as well as in the details of the illustrated construction may be made without departing from the spirit of the invention.

I claim:

1. A safety valve for mounting in a well tubing at a subsurface location in a well, comprising:

a housing having a longitudinal bore therethrough and adapted to be connected at its upper and lower ends to a well tubing with said bore in alignment with the bore of the well tubing;

a valve disposed in the bore of said housing for movement to and from an open position for enabling upwardly flow in said bore and a closed positions for blocking upwardly flow through said bore;

valve actuator means disposed in said housing for imparting movement to said valve to move it to and from the open and closed positions for controlling upwardly flow in the bore of the well tubing in response to a remote control signal; and lock means for mechanically locking said valve in the open position to prevent closing the valve for enabling repeated passages of well tools through said bore, said means for mechanically locking said valve selectively releasable to unlock said valve to enable closing of said valve to resume control of upwardly flow.

2. A pressure operated safety valve for mounting in a well tubing, comprising:

a housing having a longitudinal bore therethrough and adapted to be connected at its upper and lower ends to a well tubing with said bore in alignment with the bore of the well tubing;

a valve disposed in the bore of said housing for movement to and from open position enabling upwardly flow through said bore and the bore of the well tubing and closed position for blocking upwardly flow;

valve actuator means disposed in said housing for imparting movement to said valve to move it to and from the open and closed positions for controlling upwardly flow in said bore in response to a remote control signal;

lock means for mechanically locking said valve in the open position in a releasable manner to prevent closing the valve, said lock means actuated by a preselected well tool disposed in said bore with the preselected well tool removable from said bore and the bore of the well tubing to enable upwardly flow through the bore of the well tubing with said valve locked open;

a valve actuator sleeve longitudinally movable in said housing relative thereto;

pivot means fixed in said housing and co-acting with said valve for causing the valve to rotate upon longitudinal movement of said sleeve;

spring means to normally urge said valve actuator sleeve in an upward direction to close said valve to thereby close off fluid flow upwardly through said bore of said housing; and control fluid pressure actuated means for longitudinally urging said valve actuator sleeve downwardly so as to overcome the upward force of said spring.

3. A pressure operated safety valve for mounting in a well tubing, comprising:

a housing having a longitudinal bore therethrough and adapted to be connected at its upper and lower ends to a well tubing with said bore in alignment with the bore of the well tubing;

a ball-type valve disposed in the bore of said housing for rotational movement to and from open and closed positions;

valve actuator means disposed in said housing for imparting rotational movement to said valve to move it to and from the open and closed positions;

lock means in said housing for mechanically locking said valve in the open position in a releasable manner to prevent fluid pressure from thereafter closing the valve, said lock means including;

a piston disposed in said housing for longitudinal downward movement when a predetermined downward pressure acts thereon;

a locking detent movable downwardly with said piston; and a locking recess in said housing into which said detent is adapted to move when laterally aligned therewith.

4. A pressure operated safety valve for mounting in a well tubing, comprising:

a housing having a longitudinal bore therethrough and adapted to be connected at its upper and lower ends to a well tubing with said bore in alignment with the bore of the well tubing;

a ball-type valve disposed in the bore of said housing for rotational movement to and from open and closed positions;

valve acuator means disposed in said housing for imparting rotational movement to said valve to move it to and from the open and closed positions;

lock means in said housing for mechanically locking said valve in the open position to prevent fluid pressure from thereafter closing the valve;

a piston disposed in said housing for longitudinal downward movement when a predetermined downward pressure acts thereon;

a locking detent movable downwardly with said piston;

a locking recess in said housing into which said detent is adapted to move when laterally aligned therewith; and a valve actuator sleeve disposed inwardly of said piston and movable independently of said piston during the normal opening and closing of said valve.

5. The structure set forth in claim 4, wherein:

said lock means includes a locking sleeve; and said valve actuator sleeve has means therewith engageable by said locking sleeve when said locking sleeve is in engagement with said locking detent and said locking detent is in said locking recess to thereby lock said valve actuator sleeve to said housing to prevent relative movement therebetween.

6. The structure set forth in claim 5, including:

resilient means preventing said detent from becoming laterally aligned with said recess until a predetermined pressure differential acts across said piston to move same downwardly.

7. The structure set forth in claim 4, wherein:

a tubular portion has a first port means above said piston and a second port means below said piston for normally providing equal fluid pressure above and below said piston; and said first port means and said second port means being spaced apart a sufficient distance to receive a bridge plug therebetween whereby a greater fluid pressure may be developed above said piston for moving same downwardly to laterally align said detent with said locking recess.

8. A pressure operated safety valve for mounting in a well tubing comprising:

a housing having a longitudinal bore therethrough and adapted to be connected at its upper end to a well tubing and having threads at its lower end;

an adapter having threads connected to the threads on the lower end of said housing and adapted for connection to tubing therebelow;

a ball-type valve having a flow passage therethrough which has substantially the same internal diameter as the internal diameter of the bore of the well tubing;

a valve actuator sleeve mounted in said housing for longitudinal movement relative to said housing for moving said valve to and from open and closed positions;

said sleeve including an upper sleeve section and a lower sleeve section;

eccentric pivot means disposed between said housing and said valve;

retaining means confined longitudinally between the said pivot means and said adapter for holding said pivot means longitudinally fixed relative to said housing but permitting longitudinal removal of said pivot means upon a release of said adapter from said housing;

said valve having spherical surfaces of greater maximum diameter than the inside diameter of the threads on the lower end of said housing; and said threads on the lower end of said housing being axially cut away to provide four longitudinal slots for the longitudinal passage of said ball-type valve therethrough when said valve is disposed in the transverse closed position.

9. A safety valve for mounting in a well tubing, comprising:

a housing having a longitudinal bore therethrough and adapted to be connected at its upper and lower ends to a well tubing with said bore in communication with the bore of the well tubing;

a valve disposed in the bore of said housing for movement to and from an open position for enabling upwardly flow of fluid through said bore of said housing and a closed position for closing off upwardly flow of fluid through said bore of said housing;

valve actuator means disposed in said housing for imparting movement to said valve to move it to and from the open and closed positions to control the upwardly flow; and lock means for releasably locking said valve in the open position to thereafter prevent closing of the safety valve for enabling repeated passages of well tools through said bore.

10. The structure set forth in claim 9, including:

fluid control means for operating said valve actuator means.

11. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions; and lock means for releasably locking said valve in the open position to thereafter maintain the valve in the open position wherein the safety valve operation is stopped, said lock means actuated to lock by a well tool withdrawable from said bore and the well tubing without releasing said lock means.

12. The structure as set forth in claim 11, wherein said valve actuator means includes:

a valve actuator member movable in said housing relative thereto; and pivot means co-acting with said ball-type valve for causing the valve to rotate to and from the open and closed positions upon relative movement between said pivot means and said ball-type valve.

13. The structure set forth in claim 11, wherein said lock means includes:

a piston disposed in said housing for movement therein when a directional pressure acts thereon for rotating said ball-type valve open;

a locking detent movable with said piston;

a locking recess formed in a surface of said housing into which said detent is adapted to move when said ball-type valve is rotated open and in which said detent is locked by said piston wherein said detent locks said ball-type valve open.

14. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions;

lock means in said housing for releasably locking said valve in the open position to thereafter maintain the valve in the open position wherein the safety valve operation is stopped;

a valve actuator member movable in said housing relative thereto;

pivot means co-acting with said ball-type valve for causing the valve to rotate to and from the open and closed positions upon relative movement between said pivot means and said ball-type valve spring means to normally urge said valve actuator member to move in a first direction to close said valve to thereby close off fluid flow through said bore of said housing; and control fluid pressure means for urging said valve actuator sleeve to move in a second direction to overcome the force of said spring means and to establish a predetermined pressure which must thereafter be developed in said bore of said housing to automatically move said valve actuator member to close said valve.

15. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions; and lock means in said housing for releasably locking said valve in the open position to thereafter maintain the valve in the open position wherein the safety valve operation is stopped;

piston disposed in said housing for movement therein when a directional pressure acts thereon for rotating said ball-type valve open;

a locking detent movable with said piston;

a locking recess formed in a surface of said housing into which said detent is adapted to move when said ball-type valve is rotated open and in which said detent is locked by said piston wherein said detent locks said ball-type valve open;

a valve actuator member disposed in said bore of said housing and movable independently of said piston during the normal opening and closing of said valve.

16. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions;

lock means in said housing for releasably locking said valve in the open position to thereafter maintain the valve in the open position wherein the safety valve operation is stopped;

a piston disposed in said housing for movement therein when a directional pressure acts thereon for rotating said ball-type valve open;

a locking detent movable with said piston;

a locking recess formed in a surface of said housing into which said detent is adapted to move when said ball-type valve is rotated open and in which said detent is locked by said piston wherein said detent locks said ball-type valve open;

a valve actuator member disposed in said bore of said housing and movable independently of said piston during the normal opening and closing of said valve said lock means includes a locking member disposed in said housing; and said valve actuator member having means therewith engagable by said locking member when said locking member engages with said locking detent locked in said locking recess to lock said valve actuator member with said housing to prevent movement thereof for rotating said ball-type valve closed.

17. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions;

lock means in said housing for releasably locking said valve in the open position to thereafter maintain the valve in the open position wherein the safety valve operation is stopped;

a piston disposed in said housing for movement therein when a directional pressure acts thereon for rotating said ball-type valve open;

a locking detent movable with said piston;

a locking recess formed in a surface of said housing into which said detent is adapted to move when said ball-type valve is rotated open and in which said detent is locked by said piston wherein said detent locks said ball-type valve open;

a valve actuator member disposed in said bore of said housing and movable independently of said piston during the normal opening and closing of said valve said valve actuator member and said housing form a chamber therebetween having a first port means above said piston received in said chamber and a second port means below said piston for normally providing equal fluid pressure above and below said piston; and said first port means and said second port means being spaced apart a sufficient distance to receive a bridge plug therebetween wherein a greater fluid pressure may be developed in said chamber for moving said piston to lock said detent in said locking recess.

18. A safety valve for mounting in a well tubing, comprising:

housing having a bore therethrough and adapted for connection with a well tubing with said bore in communication with the bore of the well tubing;

a ball-type valve disposed in the bore of said housing for rotational movement to and from open position for enabling flow of fluid through said bore of said housing and to and from a closed position to close off flow of fluid through said bore of said housing;

valve actuator means disposed in said housing for imparting rotational movement to said valve to move it to and from the open and closed positions;

lock means in said housing for releasably locking said valve in the open position to thereafter maintain the valve in the open position wherein the safety valve operation is stopped;

a piston disposed in said housing for movement therein when a directional pressure acts thereon for rotating said ball-type valve open;

a locking detent movable with said piston;

a locking recess formed in a surface of said housing into which said detent is adapted to move when said ball-type valve is rotated open and in which said detent is locked by said piston wherein said detent locks said ball-type valve open;

resilient means preventing said detent from aligning with said locking recess until a predetermined pressure differential acts across said piston to move said piston for locking said locking detent in said locking recess.

19. A safety valve for mounting in a well tubing, comprising:

a housing having a longitudinal bore therethrough and adapted to be connected at a first end to a well tubing and having threads at a second end;

an adapter having threads connected to the threads on the second end of said housing and adapted for connection to the well tubing therebelow;

a ball-type valve having a flow passage therethrough and a spherical surface portion thereof with said flow passage having substantially the same internal diameter as the internal diameter of the bore of the well tubing and said surface portion formed of a diameter greater than the inside diameter of said bore of said housing adjacent said second end; and said housing having a portion thereof removed adjacent said second end to enable passage of said ball-type valve into said bore of said housing wherein said ball is enabled to move longitudinally into said bore of said housing.

20. The invention as set forth in claim 19, wherein the removed portion of said housing includes:

said removed portion adjacent said second end of said housing is axially cut away to provide four longitudinal slots for the longitudinal passage of said valve therethrough when said valve is disposed in the transverse closed position.

21. A valve for mounting in a well tubing having a bore therethrough comprising: p1 a housing having a bore therethrough and adapted to be mounted with a well tubing with said bore in communication with the bore of the well tubing;

a ball-type valve disposed in the bore of said housing for rotational movement to and from an open position for enabling flow of fluid through said bore of said housing and to and from a closed position to close flow of fluid through said bore of said housing; and said ball-type valve having spherical surfaces of relative greater diameter than the inside diameter of a portion of said housing through which said ball-type valve is inserted in assembling the valve.

22. The structure as set forth in claim 21 wherein said portion of said housing having an inside diameter less than the relative greater diameter of said ball-valve is axially slotted to enable insertion of said ball-type valve into said bore of said housing.

23. The structure as set forth in claim 22 wherein said ball-type valve is disposed in a transverse closed position in moving through said axially slotted portion of said housing into said bore of said housing.

24. The structure as set forth in claim 21 wherein said housing portion is cut away to provide longitudinal slots to enable insertion of said ball-type valve into said bore of said housing.

25. The structure as set forth in claim 21 wherein the portion of said housing having an inside diameter less than the relative greater diameter of said ball-type valve forms threads for assembling the valve.

26. The structure as set forth in claim 21, including:

said ball-type valve having a flow passage formed therethrough with said flow passage having an inside diameter substantially equal to the diameter of the bore of the well tubing.

27. A method of assembling in a well tool a rotatable ball-type valve having a portion of greater relative diameter than the diameter of the bore of a portion of the well tool housing through which the ball-type valve must pass in moving to the assembled position, including the steps of:

forming a slot in the portion of the housing having a relatively smaller bore diameter through which the ball-type valve must pass during assembly of the well tool;

turning the ball-type valve to position the maximum diameter portion thereof in the slots; and moving the ball-type valve through the relatively smaller bore diameter portion of the housing to the assembled position.

28. The method as set forth in claim 27, including the step of:

receiving a pivot pin in the ball-type valve for effecting operating rotation thereof.

29. The method as set forth in claim 28, wherein the step of receiving a pivot pin includes rotation of the ball-type valve.

30. The method as set forth in claim 27, including the step of:

engaging the ball-type valve with a seat for establishing sealing contact therebetween.

31. The method as set forth in claim 27, including the step of:

forming a plurality of slots in the portion of the housing having a relatively smaller bore diameter through which the ball-type valve must pass during assembly of the well tool.

32. A well flow control system for a well having a flow conductor therein communicating with the producing formation in the bore of the well and supported at the surface by a well head assembly and having flow line connections at the surface, including:

a flow control valve in said flow conductor having a valve closure member therein movable between positions opening and closing off flow through said valve;

actuating means in said valve for actuating the valve closure means movable longitudinally of said valve for actuating said valve closure means between open and closed position;

valve locking means in said valve initially in an inoperative position in said valve and movable to an operative position engaging said longitudinally movable valve actuating means to positively lock said valve actuating means in position holding said valve closure means open; and means releasably holding said locking means in position holding the valve open and releasable to unlock said valve locking means for movement from such position to the initial inoperative position to permit resumption of operation of the valve in a normal manner.

33. A well flow conductor valve including:

a housing having means for connecting it in flow communication with a well flow conductor;

valve means disposed in the housing and movable therein between open and closed positions for controlling flow through the housing;

operating means in said housing movable longitudinally thereof for actuating said valve to move the same between open and closed positions;

locking means in the housing initially in an inoperative position spaced from said operating means and movable to a position engaging said valve operating means to positively lock said valve operating means in position holding said valve in open position; and said locking means is releasably held in position locking said valve operating means in position holding the valve open, and is releasable from engagement with said valve actuating means for movement to said initial inoperative position to permit the valve to resume operation.

34. A well flow control system for a well having a flow conductor therein, including:

a flow control valve in said flow conductor having a valve closure member therein movable between positions opening and closing off flow through said valve;

actuating means in said valve for actuating the valve closure means movable longitudinally of said valve for actuating said valve closure means between open and closed position;

valve locking means in said valve initially in an inoperative position in said valve and movable to an operative position engaging said longitudinally movable valve actuating means to positively lock said valve actuating means in position holding said valve closure means open; and means releasably holding said locking means in position holding the valve open and releasable to unlock said valve locking means for movement from such position to the initial inoperative position to permit resumption of operation of the valve in a normal manner.

35. A well flow conductor valve including:

a housing having means for connecting it in flow communication with a well conductor;

valve means disposed in the housing and movable therein between open and closed positions for controlling flow through the housing;

operating means in said housing movable longitudinally thereof for actuating said valve to move the same between open and closed positions;

locking means in the housing initially in an inoperative position and movable to a position engaging said valve operating means to positively lock said valve operating means in position holding said valve in open position; and said locking means is releasably held in position locking said valve operating means in position holding the valve open, and is releasable from engagement with said valve actuating means for movement to said initial inoperative position to permit the valve to resume operation.

36. A method of operating a well including:

installing a flow conductor in said well for conducting fluids from a producing formation therein to the surface;

controlling flow through said flow conductor by a valve in said flow conductor controlled by control fluid from the surface;

moving said valve to open position independently of said control fluid from the surface;

locking said valve in such open position for performing well servicing operations through the open valve; and providing a supplemental subsurface valve for control of fluid flow through the first valve while said first valve is held in the open position.

37. In a shutoff valve for wells, including:

said valve including an elongated valve body having a passage extending therethrough;

valve means in said body including a valve element shiftable between a first position closing said passage and a second position at which said passage is open;

means for shifting said valve member from said second position to said first position;

control fluid pressure responsive means for shifting said valve member from said first position to said second position;

said control fluid pressure responsive means including means defining a control fluid pressure chamber;

valve operating means having an actuator sleeve having a piston exposed to control fluid pressure in said chamber;

auxiliary shifting means operable by a tool movable into said passage for operably moving said actuator sleeve to move said valve element to said second position from said first position;

said auxiliary shifting means including a shifting sleeve shiftable from an initial position to a position holding said valve element in said second position;

said auxiliary shifting means including latch means for holding said shifting sleeve in said latter position;

said latch means including a resilient latch ring interposed between said body and said shifting sleeve; and one of said shifting sleeves and said body having latch elements engageable by said latch ring when said shifting sleeve is in said latter position.

38. In a shutoff valve for wells, including:

said valve including an elongated valve body having a passage extending therethrough;

valve means in said body including a valve element shiftable between a first position closing said passage and a second position at which said passage is open;

means for shifting said valve member from said second position to said first position;

control fluid pressure responsive means for shifting said valve member from said first position to said second position;

said control fluid pressure responsive means including means defining a control fluid pressure chamber;

valve operating means having an actuator sleeve having a piston exposed to control fluid pressure in said chamber;

auxiliary shifting means operable by a tool movable into said passage for operably moving said actuator sleeve to move said valve element to said second position from said first position;

said auxiliary shifting means including a shifting sleeve in said passage shiftable from an initial position to a position holding said valve element in said second position;

said auxiliary shifting means including latch means for holding said shifting sleeve in said latter position;

said latch means including a resilient latch ring interposed between said body and said shifting sleeve; and one of said shifting sleeve and said body having latch elements engageable by said latch ring when said shifting sleeve is in said latter position and the other of said shifting sleeve and said body having means for forcing said latch ring into locking engagement with said latch elements to hold said shifting sleeve in said latter position.

39. A subsurface safety valve system for controlling flow of well fluids at a subsurface location in a well tubing in response to a control signal from the surface, including:

a housing mountable in a well tubing at a subsurface location;

a flow closure element operably mounted with said housing for movement to and from an open position for enabling flow through the well tubing and a closed position for blocking flow through the well tubing;

actuator means for moving said flow closure element to and from the open and closed position in response to a control signal from the surface;

lock means for securing said flow closure element in the open position; said lock means actuated by a tool removably positioned in said housing by movement through the well tubing to the subsurface location;

said lock means is releasable to enable said closure element to move to the closed position after being locked open; and a second subsurface safety valve positioned in the well tubing adjacent said housing to control flow through the well tubing when said flow closure element is locked in the open position.

* * * * *